US009233811B1

(12) United States Patent
Shiba

(10) Patent No.: US 9,233,811 B1
(45) Date of Patent: Jan. 12, 2016

(54) IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Tetsuo Shiba, Yokohama Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/599,129

(22) Filed: Jan. 16, 2015

(51) Int. Cl.
*B65H 9/00* (2006.01)
*B65H 5/06* (2006.01)

(52) U.S. Cl.
CPC ..... *B65H 5/062* (2013.01); *B65H 9/006* (2013.01); *B65H 2404/143* (2013.01); *B65H 2404/54* (2013.01); *B65H 2404/696* (2013.01)

(58) Field of Classification Search
CPC .... B65H 5/062; B65H 5/06; B65H 2404/143; B65H 2404/54; B65H 2404/696; B65H 2404/6961; B65H 9/006
USPC ..... 271/242
See application file for complete search history.

(56) References Cited

U.S. PATENT DOCUMENTS

| | | | | |
|---|---|---|---|---|
| 4,959,685 | A * | 9/1990 | Kato | 355/72 |
| 5,280,901 | A * | 1/1994 | Smith et al. | 271/188 |
| 2003/0133732 | A1 * | 7/2003 | Quesnel | B65H 9/006 399/388 |
| 2006/0049257 | A1 * | 3/2006 | Reiter | 235/449 |
| 2012/0211939 | A1 * | 8/2012 | Storey et al. | 271/226 |

* cited by examiner

*Primary Examiner* — David H Bollinger
(74) *Attorney, Agent, or Firm* — Patterson & Sheridan, LLP

(57) ABSTRACT

An image forming apparatus comprises a driving roller and at least one spherical driven roller. The driving roller and the at least one spherical driven roller nip a sheet therebetween from opposite sides of the sheet to convey the sheet.

18 Claims, 5 Drawing Sheets

IMAGE FORMING APPARATUS

FIELD

Embodiments described herein relate generally to an image forming apparatus.

BACKGROUND

An image forming apparatus conveys a medium (hereinafter referred to as "sheet") such as paper and forms an image on the sheet. The image forming apparatus is provided with a register roller for aligning the front end part of the sheet and a conveyance roller for conveying the sheet towards the register roller. The conveyance roller abuts the front end of the sheet against the stopped register roller. The conveyance roller deflects the sheet to align the front end of the sheet. However, if the skew amount of the sheet in the conveyance direction is too large, there is a possibility that the register roller cannot align the front end of the sheet.

DETAILED DESCRIPTION

Figure 1:
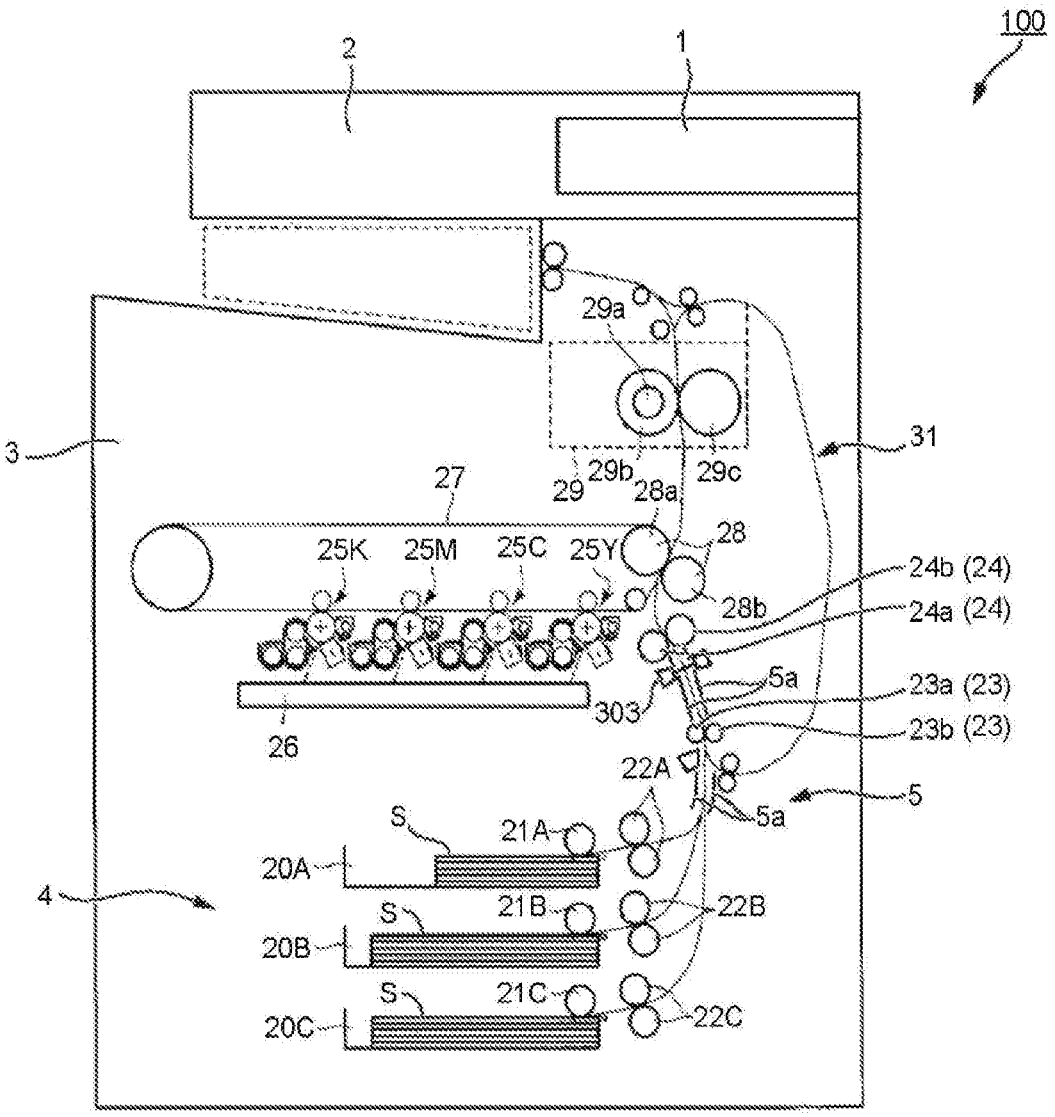
FIG. 1 is a cross-sectional view illustrating an example arrangement of an image forming apparatus according to one embodiment.

In accordance with one embodiment, an image forming apparatus comprises a driving roller and at least one spherical driven roller. The driving roller and the at least one spherical driven roller nip a sheet therebetween from opposite sides of the sheet to convey the sheet.

Hereinafter, an image forming apparatus 100 according to the embodiment is described with reference to the accompanying drawings. The same components in each figure are described with the same reference numerals.

FIG. 1 is a cross-sectional view illustrating an example arrangement of the image forming apparatus 100 according to one embodiment.

As shown in FIG. 1, the image forming apparatus 100 includes a control panel 1, a scanner section 2, a printer section 3, a sheet storage section 4 and a conveyance section 5.

The scanner section 2 reads image data of a copy object and outputs the read image data to the printer section 3.

The printer section 3 transfers an output image (hereinafter referred to as toner image) developed with a developing agent such as toner to a sheet S serving as an image transferred medium, based on the image data output from the scanner section 2. The printer section 3 applies heat and pressure to the sheet S to fix the toner image on the sheet S.

The sheet storage section 4 supplies the sheet S, one by one, to the printer section 3 when the toner image is formed in the printer section 3. The sheet storage section 4 includes a plurality of sheet feed cassettes 20A, 20B and 20C. Each sheet feed cassette 20A, 20B and 20C stores sheets S of a predetermined size and category. Each sheet feed cassette 20A, 20B and 20C is provided with pickup rollers 21A, 21B and 21C, respectively. Each pickup roller 21A, 21B and 21C picks up the sheet S one by one from each of the sheet feed cassettes 20A, 20B and 20C. The pickup rollers 21A, 21B and 21C feed the picked up sheet S to sheet feed rollers 22A, 22B and 22C. The sheet feed rollers 22A, 22B and 22C convey the sheet to the conveyance section 5.

The conveyance section 5 includes a pair of conveyance guides 5*a*, a conveyance roller 23 and a register roller 24. The conveyance roller 23 conveys the sheet S fed by the sheet feed rollers 22A, 22B or 22C towards the register roller 24. The register roller 24 conveys the sheet S when the printer section 3 is to transfer the toner image to the sheet S.

Figure 2:
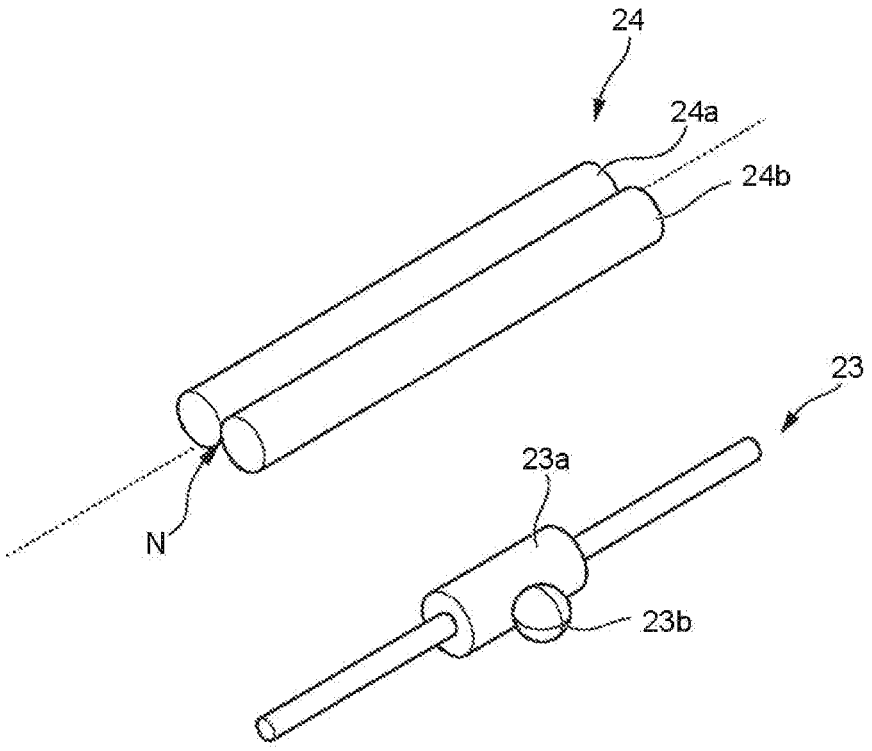
FIG. 2 is a perspective view illustrating an example of a conveyance roller and a register roller in the image forming apparatus.
Figure 3:
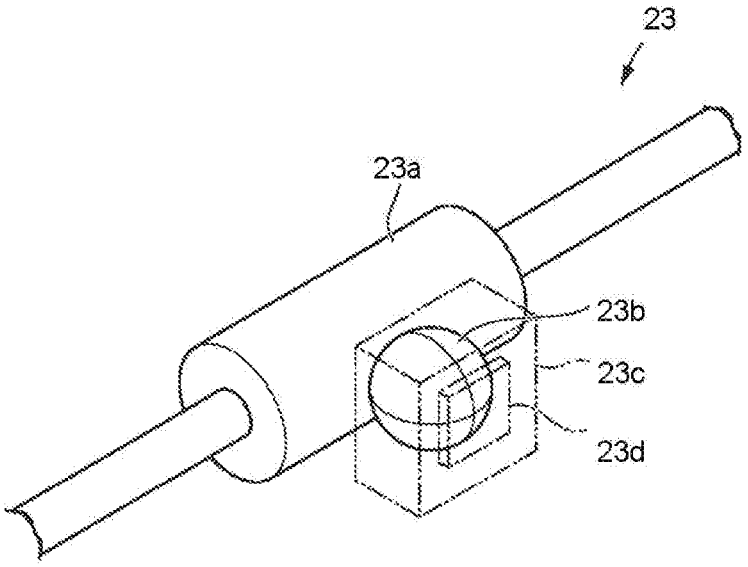
FIG. 3 is an enlarged perspective view illustrating the conveyance roller.

FIG. 2 is a perspective view illustrating an example of the conveyance roller 23 and the register roller 24. FIG. 3 is an enlarged perspective view illustrating the conveyance roller 23.

The conveyance guides 5*a* are arranged opposite to each other at a given interval in the thickness direction of the sheet S. The pair of conveyance guides 5*a* guide the sheet S fed from each sheet feed cassette 20A, 20B and 20C via the conveyance roller 23 to the register roller 24. The pair of conveyance guides 5*a* forms a space required to guide the sheet S.

The conveyance roller 23 includes a conveyance driving roller 23*a* and a conveyance driven roller 23*b*. The outer shape of the conveyance driving roller 23*a* is cylindrical. The conveyance driving roller 23*a* is rotated by a driving force from a later-described motor 312. The outer shape of the conveyance driven roller 23*b* is spherical. The conveyance driven roller 23*b* is supported by a supporting component 23*c*. The conveyance driven roller 23*b* is driven to rotate in any direction (including the conveyance direction) through the frictional force with the sheet S. The supporting component 23*c* is a box-shaped housing for supporting the conveyance driven roller 23*b* in such a manner that a sheet-contacting portion of the conveyance driven roller 23*b* is exposed. The supporting component 23*c* includes a pressing component 23*d* for pressing the conveyance driven roller 23*b* towards the conveyance driving roller 23*a*. For example, the pressing component 23*d* may be an elastic component such as a leaf spring for pressing the conveyance driven roller 23*b* towards the conveyance driving roller 23*a* through elastic force.

The conveyance driving roller 23*a* and the conveyance driven roller 23*b* are arranged opposite to each other to nip the sheet S in the thickness direction of the sheet S and to convey the sheet S. The conveyance roller 23 conveys the sheet S fed from each sheet feed cassette 20A, 20B and 20C towards the register roller 24. The conveyance roller 23 conveys the sheet S in the conveyance direction so that the front end of the sheet S abuts against a nip N of the register roller 24. The conveyance roller 23 rotates the sheet S to align the position of the front end of the sheet S to be perpendicular to the conveyance direction.

The register roller 24 includes a register driving roller 24*a* and a register driven roller 24*b*. The outer shape of the register driving roller 24*a* and the register driven roller 24*b* are cylindrical. The register driving roller 24*a* is rotated by a driving force from a later-described motor 322. The register driven roller 24*b* is driven to rotate in the conveyance direction through the frictional force with the sheet S. Alternatively, the register driven roller 24*b* is connected with the register driving roller 24*a* through a gear, or the like, and is rotated with the gear. The register driving roller 24*a* and the register driven roller 24*b* are arranged opposite to each other to nip the sheet S in the thickness direction of the sheet S and to convey the sheet S. The register roller 24 aligns the front end of the sheet S conveyed from the conveyance roller 23 in the nip N and then conveys the sheet S to a later-described transfer section 28.

As shown in FIG. 1, the printer section 3 includes an image forming section 25 (25Y, 25M, 25C and 25K), an exposure section 26, an intermediate transfer belt 27 and a transfer section 28.

The image forming section 25 (25Y, 25M, 25C and 25K) forms a toner image to be transferred to the sheet S. The image forming section 25Y forms an image with yellow toner. The image forming section 25M forms an image with magenta toner. The image forming section 25C forms an image with cyan toner. The image forming section 25K forms an image with black toner. The image forming section 25 (25Y, 25M, 25C and 25K) superimposes and transfers the image of each color onto the intermediate transfer belt 27. In this way, the image forming section 25 (25Y, 25M, 25C and 25K) forms a color image on the intermediate transfer belt 27.

The exposure section 26 faces a photoconductive drum (image carrier) of the image forming section 25 (25Y, 25M, 25C and 25K). The exposure section 26 irradiates the photoconductive drum of the image forming section 25 (25Y, 25M, 25C and 25K) with laser light. The exposure section 26 forms an electrostatic latent image (toner image) to be developed with toner on the surface of the photoconductive drum to which toner is selectively supplied by a developing device. The image forming section 25 (25Y, 25M, 25C and 25K) transfers (primarily transfers) the toner image formed on the photoconductive drum to the intermediate transfer belt 27. The image forming section (25Y, 25M, 25C and 25K) applies a transfer bias to the toner image at a primary transfer position. The image forming section (25Y, 25M, 25C and 25K) transfers the toner image on each photoconductive drum to the intermediate transfer belt 27 through the transfer bias at the primary transfer position.

The transfer section 28 transfers the charged toner image on the intermediate transfer belt 27 to the sheet S at a secondary transfer position. The secondary transfer position is a position where the supporting roller 28*a* and the secondary transfer roller 28*b* face each other. The transfer section 28 applies a transfer bias controlled through transfer current at the secondary transfer position. The transfer section 28 transfers the toner image on the intermediate transfer belt 27 to the sheet S through the transfer bias.

A fixing device 29 includes a heating roller 29*b*. A heating section 29*a* is arranged inside the heating roller 29*b*. A pressing roller 29*c* is brought into press contact with a fixing belt heated by the heating roller 29*b*. In this manner, the fixing device 29 fixes the toner image on the sheet S through heat and pressure applied to the sheet S.

The printer section 3 further includes a reversal unit 31. The reversal unit 31 reverses, through switchback, the sheet S discharged from the fixing device 29. The reversal unit 31 conveys the reversed sheet S to the inside of the conveyance guides 5*a* in front of the register roller 24 again. The reversal unit 31 reverses positions of the front side of the sheet S subjected to fixing processing by the fixing device 29 and the back side of the sheet S which is not subjected to fixing processing yet.

Figure 4:
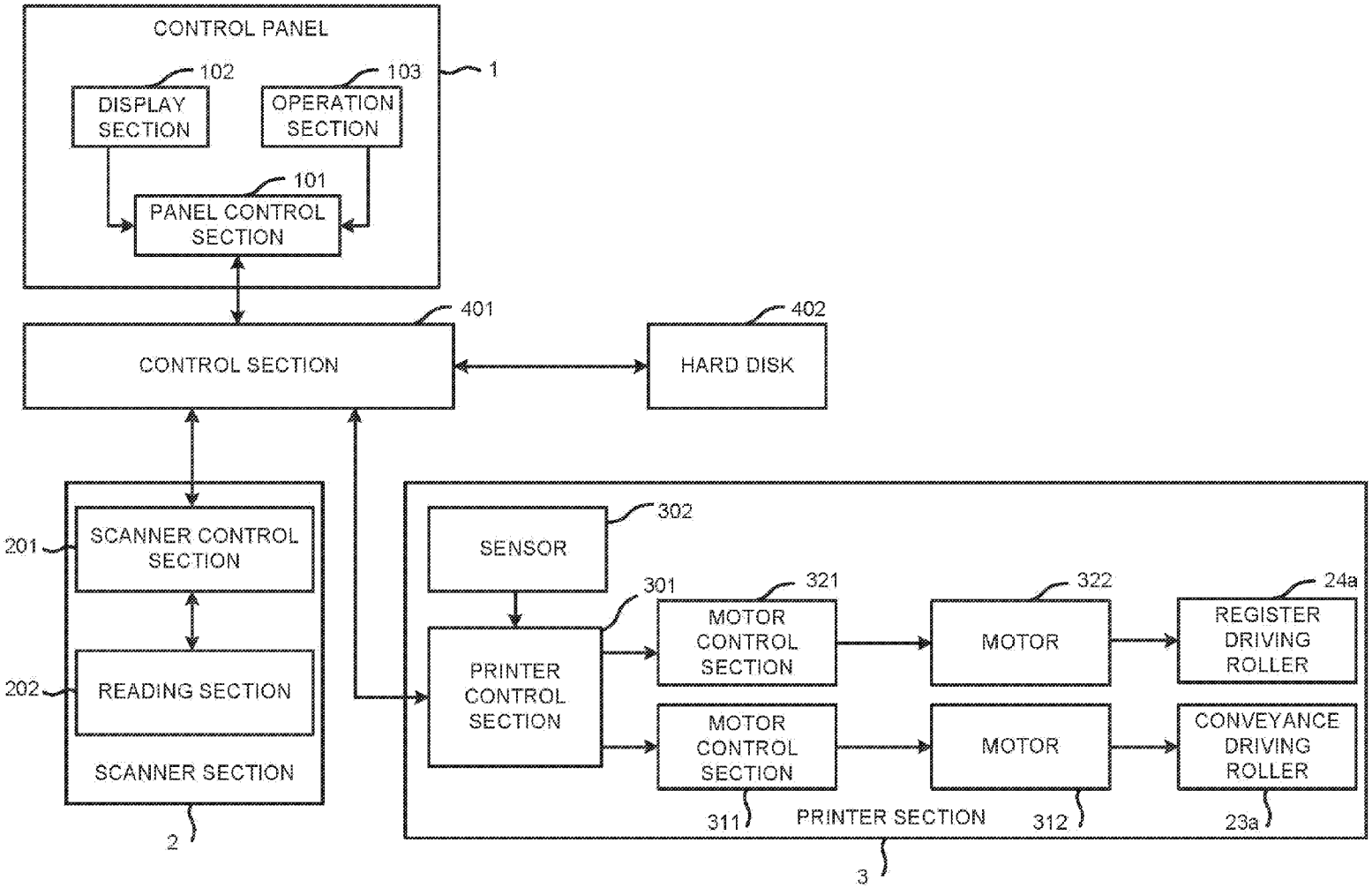
FIG. 4 is a block diagram illustrating an example configuration of the image forming apparatus.

Hereinafter, the configuration of the image forming apparatus 100 is described with reference to FIG. 4. FIG. 4 is a block diagram illustrating an example configuration of one part of the image forming apparatus 100.

The control panel 1, the scanner section 2 and the printer section 3 are connected with a control section 401 which controls each of the later-described control panel 1, the scanner section 2 and the printer section 3. The control section 401 controls the whole operations of the image forming apparatus 100. The control section 401 includes a CPU, an ROM and an RAM. The control section 401 is connected with a hard disk 402.

The hard disk 402 stores the image information from the scanner section 2 or the external device.

The control panel 1 includes a panel control section 101, a display section 102 and an operation section 103. The panel control section 101 includes a CPU, an ROM and an RAM, and controls the control panel 1.

The display section 102 outputs a screen corresponding to an operation or an image, based on an instruction from the panel control section 101.

The operation section 103 receives an operation from the user and outputs a signal indicating the operation content to the panel control section 101. The operation section 103 is provided with various keys.

The display section 102 and the operation section 103 may be integrally arranged as a touch panel type display.

The panel control section 101 displays various kinds of information such as the number of printings, the size and the category of the sheet S, and the like on the display section 102. The operation section 103 receives a designation and a change of the information displayed on the display section 102. For example, the information indicating the category of the sheet S is designated through the operation section 103. The operation section 103 outputs the information indicating the designated category of the sheet S to a printer control section 301. The printer control section 301 includes a CPU, an ROM and an RAM, and stores the designated category of the sheet S on, for example the RAM arranged inside.

The scanner section 2 includes a scanner control section 201 and a reading section 202. The scanner control section 201 includes a CPU, an ROM and an RAM, and controls the reading section 202 to read the image information.

The printer section 3 is provided with a printer control section 301. The printer control section 301 includes a CPU, an ROM and an RAM, and controls the printer section 3 to print an image on the sheet S.

The printer control section 301 controls the operation of each motor control section 311 and 321 for each of the conveyance roller 23 and the register roller 24. The motor control section 311 controls the operation of the motor 312 which drives the conveyance driving roller 23*a*. The motor control section 321 controls the operation of the motor 322 which drives the register driving roller 24*a*. The printer control section 301 receives a signal output from a sensor 302. The sensor 302 is arranged between the conveyance roller 23 and the register roller 24 to detect the passage of the sheet S.

The sensor 302 is provided with a light emitting section and a light receiving section arranged opposite to each other in the thickness direction of the conveyed sheet S. The emitted light output from the light emitting section is received by the light receiving section when there is no shield object between the light emitting section and the light receiving section. The sensor 302 outputs an ON signal in a case in which the reception of the emitted light by the light receiving section is interrupted. Specifically, for a sheet S being conveyed, the sensor 302 outputs an ON signal in a case in which the front end in the conveyance direction of the sheet S passes through the optical axis of the emitted light output from the light emitting section. The sensor 302 outputs an OFF signal when the reception of the emitted light by the light receiving section is restarted. Thus, for the sheet S being conveyed, the sensor 302 outputs an OFF signal when the rear end in the conveyance direction of the sheet S passes through the optical axis of the emitted light output from the light emitting section.

The printer control section 301 controls the conveyance of the sheet S by each of the conveyance roller 23 and the register roller 24. The conveyance roller 23 conveys the sheet S to the stopped register roller 24. The printer control section 301 maintains the register roller 24 in the stopped state for at least a predetermined time from when the sensor 302 detects the passage of the sheet S. The conveyance roller 23 conveys the sheet S between the pair of conveyance guides 5*a* to abut the front end of the sheet S against the nip N of the stopped register roller 24. The conveyance roller 23 rotates the sheet S between the pair of conveyance guides 5*a*. The conveyance driven roller 23*b* of the conveyance roller 23 is rotated in any direction to align the front end of the sheet S through the nip N of the register roller 24.

Figure 5:
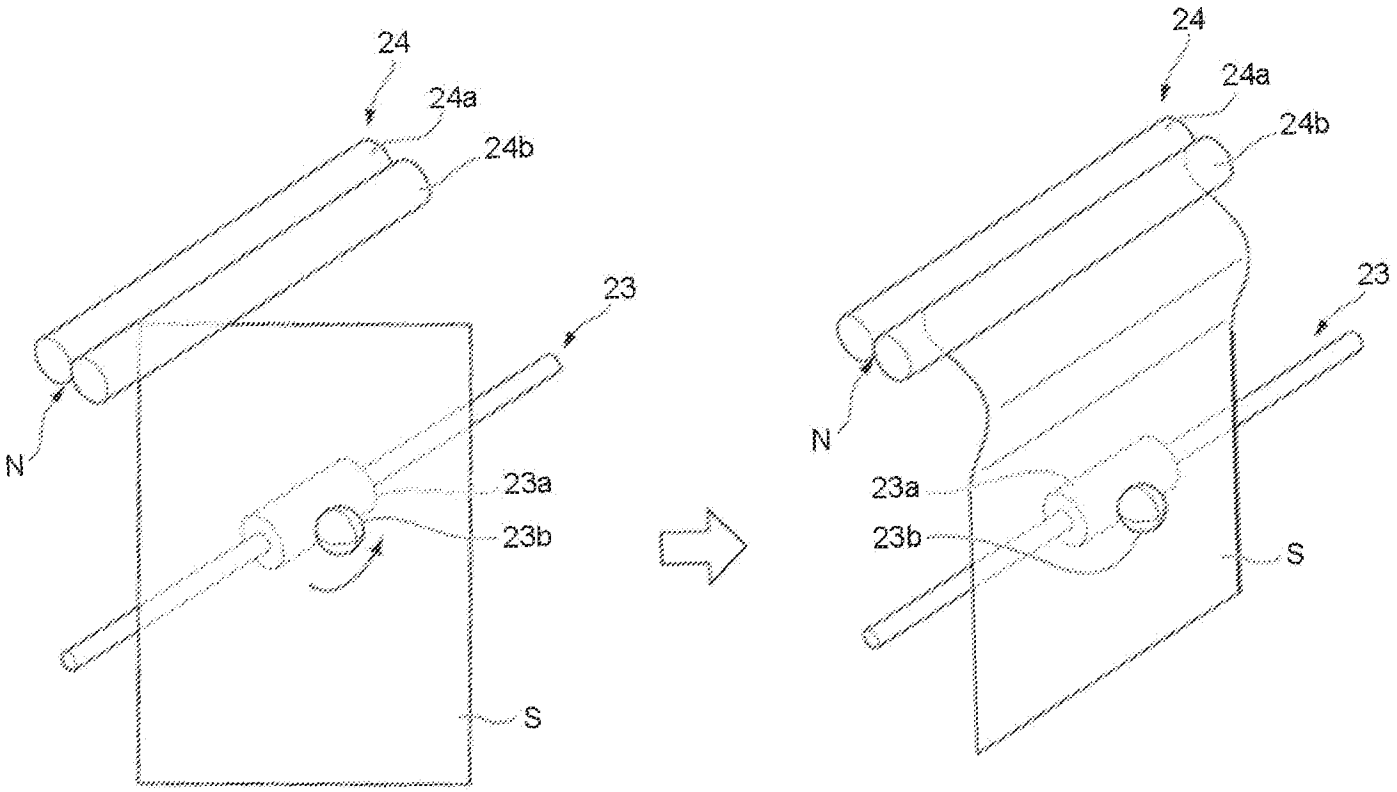
FIG. 5 is a perspective view illustrating an example operation of the conveyance roller and the register roller.

FIG. 5 is a perspective view illustrating an example of the operations of the conveyance roller 23 and the register roller 24 of the image forming apparatus 100. The conveyance driving roller 23*a* conveys the sheet S (which is skewed) in the conveyance direction through the driving force of the motor 312. The conveyance driven roller 23*b* is driven to rotate in the conveyance direction under the frictional force with the sheet S before the skewed front end of the sheet S reaches the nip N of the register roller 24. The conveyance driven roller 23*b* is rotated in any direction through the frictional force with the sheet S after the front end of the skewed sheet S reaches the nip N of the register roller 24. The sheet S abutting against the nip N of the register roller 24 is rotated by the drag from the register roller 24. The sheet S abutting against the nip N of the register roller 24 rotates around a tangent point with the conveyance driven roller 23*b* through the drag from the register roller 24. The rotation of the sheet S is stopped after the front end of the sheet S is aligned perpendicular to the conveyance direction in the nip N.

The printer control section 301 stops the conveyance of the sheet S by the conveyance roller 23 after the front end of the sheet S is aligned in the nip N of the register roller 24. The printer control section 301 restarts the conveyance of the sheet S by the conveyance roller 23 and the register roller 24 at the timing when the toner image is to be transferred to the sheet S by the transfer section 28.

The image forming apparatus 100 according to the embodiment described above is provided with a spherical conveyance driven roller 23*b* which rotates in any direction, thus, the sheet S can be rotated in any direction. The spherical conveyance driven roller 23*b* can align the front end of the skew sheet S in the conveyance direction easily allowing the sheet S to be deflected and rotated. The spherical conveyance driven roller 23*b* can align the front end of the sheet S without deflecting the sheet S beyond the space between the pair of conveyance guides 5*a*. The spherical conveyance driven roller 23*b* can align the front end of the sheet S earlier through the deflection and the rotation of the sheet S, compared with a case of aligning the front end of the sheet S through the deflection of the sheet S only.

Hereinafter, a modification of the embodiment is described. Though it is exemplified that the image forming apparatus 100 according to the embodiment described above is provided with one conveyance driven roller 23*b*, the present invention is not limited to this. The image forming apparatus 100 may be provided with a plurality of conveyance driven rollers 23*b*.

Figure 6:
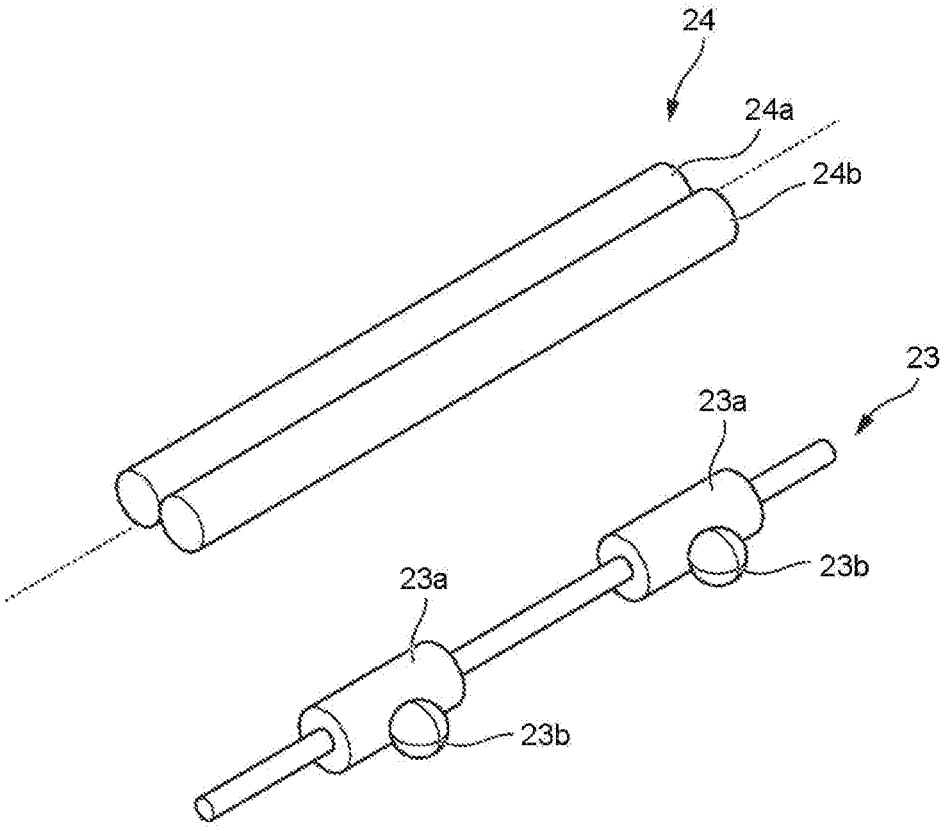
FIG. 6 is a perspective view illustrating an example configuration of a conveyance roller and a register roller of an image forming apparatus according to an alternate embodiment.

FIG. 6 is a perspective view illustrating an example of the constitution of the conveyance roller 23 and the register roller 24 of the image forming apparatus 100 according to the modification of the embodiment. The conveyance roller 23 includes one conveyance driving roller 23*a* and two conveyance driven rollers 23*b*. The conveyance driving roller 23*a* and the two conveyance driven rollers 23*b* are arranged to face each other. The conveyance driving roller 23*a* and the two conveyance driven rollers 23*b* nip the sheet S from two sides in the thickness direction of the sheet S to convey the sheet S.

The image forming apparatus 100 according to the modification is provided with a plurality of spherical conveyance driven rollers 23*b* which rotate in any direction, thus, the sheet S can be rotated in any direction.

Though it is exemplified in the embodiment described above that the supporting component 23*c* for supporting the spherical conveyance driven roller 23*b* in the image forming apparatus 100 is a box-shaped housing, the present invention is not limited to this. The image forming apparatus 100 may be provided with a supporting component having other shape other than the box-shaped supporting component 23*c*.

The image forming apparatus 100 according to the embodiment described above is exemplified as an apparatus that fixes a toner image, however, the present invention is not limited to this. For example, the image forming apparatus 100 may be an inkjet image forming apparatus.

In accordance with at least one embodiment described above, at least one spherical conveyance driven roller 23*b* is arranged in the image forming apparatus, thus, sheet S can be rotated in any direction. The spherical conveyance driven roller 23*b* can align the front end of the skew sheet S in the conveyance direction through the deflection and the rotation of the sheet S. Even in a case in which the deflection of the sheet S beyond the space between the pair of conveyance guides 5*a* is needed to align the front end of the sheet S, the spherical conveyance driven roller 23*b* can align the front end correctly through rotation. The spherical conveyance driven roller 23*b* can align the front end of the sheet S earlier through the deflection and the rotation of the sheet S, compared with a case of aligning the front end of the sheet S through the deflection of the sheet S only.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

a driving roller and at least one spherical driven roller configured to nip and convey a sheet therebetween in a conveyance direction; and a pair of register rollers arranged downstream of the driving roller and the driven roller in the conveyance direction of the sheet, the pair of register rollers forming a nip, wherein when a front end of the sheet conveyed by the driving roller abuts the nip, the driving roller and the driven roller align the front end of sheet.

2. The image forming apparatus according to claim 1, wherein the driven roller is rotatable in any direction.

3. The image forming apparatus according to claim 1, further comprising:

a control section configured to drive the driving roller in a state in which the front end of the sheet is abutted against the register rollers that have been stopped.

4. The image forming apparatus according to claim 3, further comprising:

a sensor to detect the sheet, the sensor arranged between the register rollers and the driving roller, wherein the control section drives the driving roller in the state in which the register rollers have been stopped, for a predetermined period of time after the sensor detects the sheet.

5. The image forming apparatus according to claim 1, further comprising:

a supporting component that supports the driven roller so as to allow the driven roller to be rotated in any direction.

6. The image forming apparatus according to claim 5, further comprising:

a pressing component that presses the driven roller towards the driving roller.

7. The image forming apparatus according to claim 6, wherein the pressing component comprises an elastic component that presses the driven roller towards the driving roller through elastic force.

8. The image forming apparatus according to claim 7, wherein the elastic component comprises a leaf spring.

9. The image forming apparatus according to claim 1, wherein the driving roller and the driven roller are arranged upstream of a transfer position of the sheet in the conveyance direction of the sheet.

10. An image forming apparatus, comprising:

a first driving roller and a first spherical driven roller configured to nip a first portion of a sheet therebetween;

a second driving roller and a second spherical driven roller to nip a second portion of the sheet therebetween;

a control section configured to drive the first and second driving rollers to convey the sheet in a conveyance direction; and a pair of register rollers arranged downstream of the driving rollers and the driven rollers in the conveyance direction of the sheet, the pair of register rollers forming a nip, wherein when a front end of the sheet conveyed by the driving rollers abuts the nip, the driving rollers and the driven rollers align the front end of sheet.

11. The image forming apparatus according to claim 10, wherein the first and second driven rollers are each rotatable in any direction.

12. The image forming apparatus according to claim 10, wherein the control section is configured to drive the first and second driving rollers in a state in which the front end of the sheet is abutted against the register rollers that have been stopped.

13. The image forming apparatus according to claim 12, further comprising:

a sensor to detect the sheet, the sensor arranged between the register rollers and the first and second driving rollers, wherein the control section drives the first and second driving rollers in the state in which the register rollers have been stopped for a predetermined period of time after the sensor detects the sheet.

14. The image forming apparatus according to claim 10, further comprising:

first and second supporting components that support the first and second driven rollers, respectively, so as to allow the respective driven roller to be rotated in any direction.

15. The image forming apparatus according to claim 14, further comprising:

a first pressing component that presses the first driven roller towards the first driving roller; and a second pressing component that presses the second driven roller towards the second driving roller.

16. The image forming apparatus according to claim 15, wherein each of the first and second pressing components comprises an elastic component that presses the respective one of the first and second driven rollers towards the corresponding driving roller through elastic force.

17. The image forming apparatus according to claim 16, wherein the elastic component comprises a leaf spring.

18. The image forming apparatus according to claim 10, wherein the first and second driving rollers and the first and second driven rollers are arranged upstream of a transfer position of the sheet in the conveyance direction of the sheet.

* * * * *